United States Patent [19]

Jekat et al.

[11] Patent Number: 4,565,453

[45] Date of Patent: Jan. 21, 1986

[54] AGITATOR

[75] Inventors: Herbert Jekat, Schopfheim; Rainer Junghaus, Lörrach; Walter Geng, Schopfheim, all of Fed. Rep. of Germany; Vagn Petersen, Birkerod, Denmark

[73] Assignee: Ekato Industrieanlagen Verwaltungsgesellschaft mbH & Co., Schopfheim, Fed. Rep. of Germany

[21] Appl. No.: 674,017

[22] Filed: Nov. 21, 1984

[30] Foreign Application Priority Data

Nov. 21, 1983 [DE] Fed. Rep. of Germany ..... 3341960

[51] Int. Cl.[4] ..... B01F 7/16

[52] U.S. Cl. ..... 366/279; 366/343; 384/134; 384/478

[58] Field of Search ..... 366/279, 285, 286, 342, 366/343, 345, 348, 349; 277/34, 34.3, 34.6, DIG. 1; 384/134, 478; 415/175; 417/368

[56] References Cited

U.S. PATENT DOCUMENTS

| | | | |
|---|---|---|---|
| 2,516,918 | 8/1950 | Roubal | 384/134 |
| 2,665,122 | 1/1954 | Rowland | 366/262 |
| 3,954,348 | 5/1976 | Renaud | 415/175 |
| 4,065,232 | 12/1977 | Stratienko | 417/368 |

*Primary Examiner*—Robert W. Jenkins

*Attorney, Agent, or Firm*—Michael J. Striker

[57] ABSTRACT

The invention relates to an agitator for the agitation of liquid media, and more specially for use while completely submerged in the medium. The bearings and the coupling for the agitator shaft are placed in a downwardly opening gastrap, there being a gas cushion between the bearings and the coupling on the one hand and the medium to be agitated on the other hand in order to keep the medium clear of the bearings and the coupling and damaging same.

The gas cushion may replenished through a supply duct periodically or continuously.

9 Claims, 2 Drawing Figures

AGITATOR

The invention relates to an agitator for the agitation of liquid media, comprising a shaft to be driven by a motor and agitating vanes mounted on the shaft, bearings for the shaft and a coupling between the motor and the shaft, more specially for use in a completely submerged condition.

Agitators of this sort are used inter alia in off-shore operations in connection with the production of petroleum, as for example on tankers. The medium to be agitated is in this case oil, but it may however be water or another liquid. The agitator is generally run while completely submerged in the medium to be agitated, the bearing means of the agitator shaft, the driving motor and the coupling between the motor and the agitator shaft being under the level of the liquid. Therefore in the case of this method of operation steps have to be taken to see that more specially the bearings and the coupling are not damaged by the medium.

Consequently the object of the invention is to make such a development of the agitator of the design noted hereinbefore that the medium to be agitated does not make its way to the bearings and the coupling of the agitator.

This is made possible in keeping with the invention inasfar as the bearings and the coupling are protected against the medium by a downwardly open housing which functions as a gastrap.

Preferably the gastrap is filled with a gas, more specially air, under a suitable pressure in order to generally keep the medium out of the gastrap.

Conveniently the gastrap may be supplied with gas in order to maintain a gas cushion in its inner space by way of a duct joined to the gastrap.

The design may be such that the medium rises in the gastrap to given level but however with a sufficiently large clearance from the bearings and the coupling; in order to make certain that as little as possible of the gas penetrates into the liquid because of the turbulent mass exchange at the surface, floats are arranged in the lower part of the downwardly opening gastrap, such floats coming to the surface of the medium making its way into the gastrap and covering over at least the surface of the medium.

Preferably the space within the gastrap, wherein the bearings and the coupling are accommodated is generally filled with synthetic resin in order to reduce the gas volume.

Conveniently, an impeller is mounted on the shaft at a given distance from the lower end of the gastrap, such impeller conveying outwards and expelling any solid particles that, entrained in the medium, have made their way into the gastrap and come down as sediment. Such expulsion by the impeller prevents the lower part of the volume of the gastrap from being fouled by such particles. In place of using such an impeller, the lower end of the gastrap may be designed so as a conical structure pointing towards the agitator shaft so that there is a given clearance between the passage opening of the gastrap and the outer face of the agitator shaft, which any solid particles, entrained with the medium into the gastrap and having formed a sediment therein, may be moved outwards and expelled through.

In addition to the seal using a gas it is possible to have a lip-type shaft seal or a sealing bushing. In the case of the use of a sealing bushing it is best for the space accommodating the bearings and the coupling in the gastrap to be charged with oil in order to lubricate the sealing bushing.

In the event of the agitator operating in oil, it is possible to have a connecting hole between the compartment filled with the oil and the outer side of the gastrap, such hole however being fitted with a strainer or frit filter in order to keep out solids and more specially particles of dirt.

An account will now be given of one working example of the invention with reference to the drawing.

FIG. 1 shows a container 66 as for example the hold of a tanker, that is filled with a liquid, as for example oil, whose surface or level is referenced 26.

Figure 1:
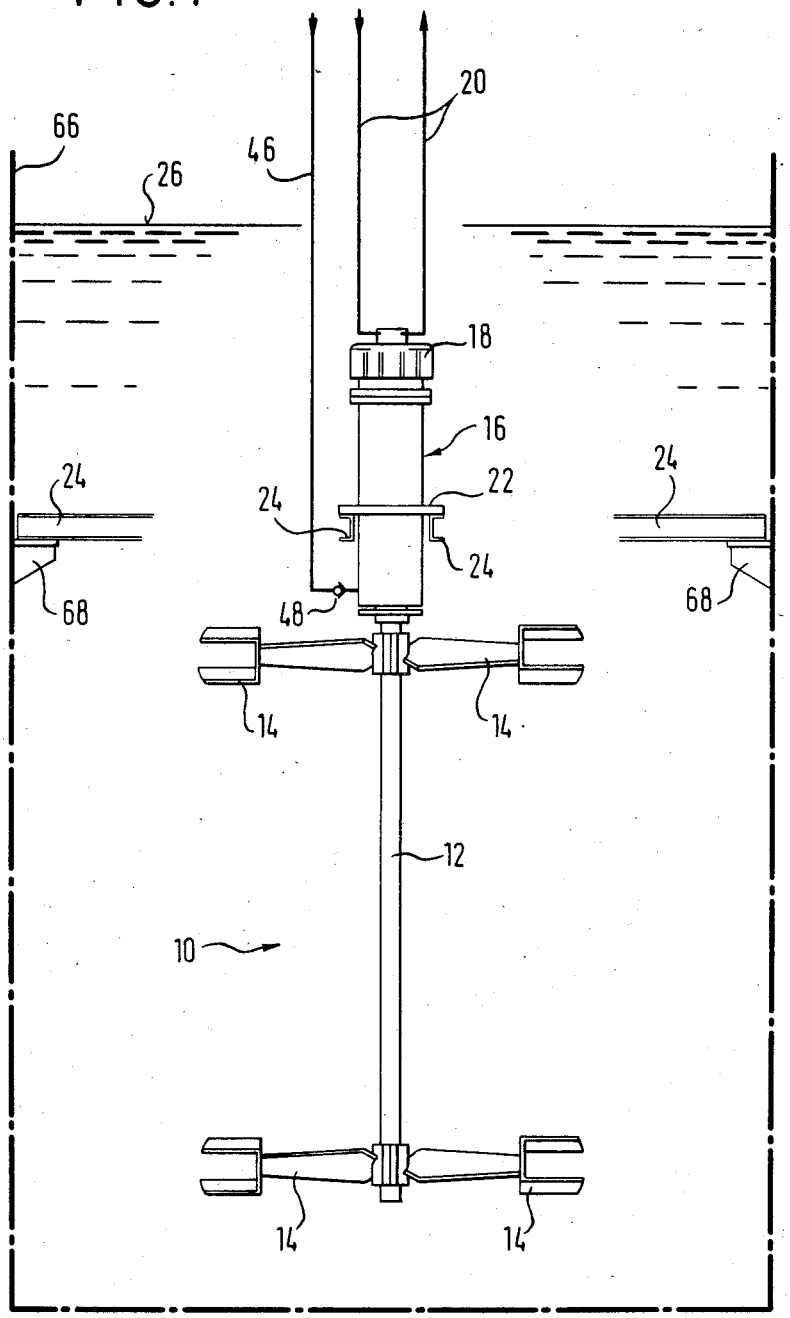
FIG. 1 is a diagrammatic view of an agitator, that is run in a container and completely submerged in the medium to be agitated.

An agitator 10 is completely submerged in this liquid, that is to say the medium to be agitated, all the parts of the agitator being under the level 26 of the liquid.

The agitator 10 consists of a shaft 12, on which a number of agitating vanes 14 are fixed. The top end, not visible in FIG. 1, of the shaft 12 is bearinged in a gastrap 16, and is connected by way of a coupling in the gastrap with a drive motor 18, that is flange mounted on the top end of the gastrap 16. The motor 18 may be an electric motor or one driven by a fluid, as for example a hydraulic motor, and it is furnished with connection ducts 20 for the supply of energy thereto.

The gastrap 16 is fitted with a flange 22, that is supported on beams 24 and is firmly joined thereto. Such beams are supported on brackets 68 and joined to same. The brackets 68 are for example fixed to the wall of the container 66 on the inside.

Figure 2:
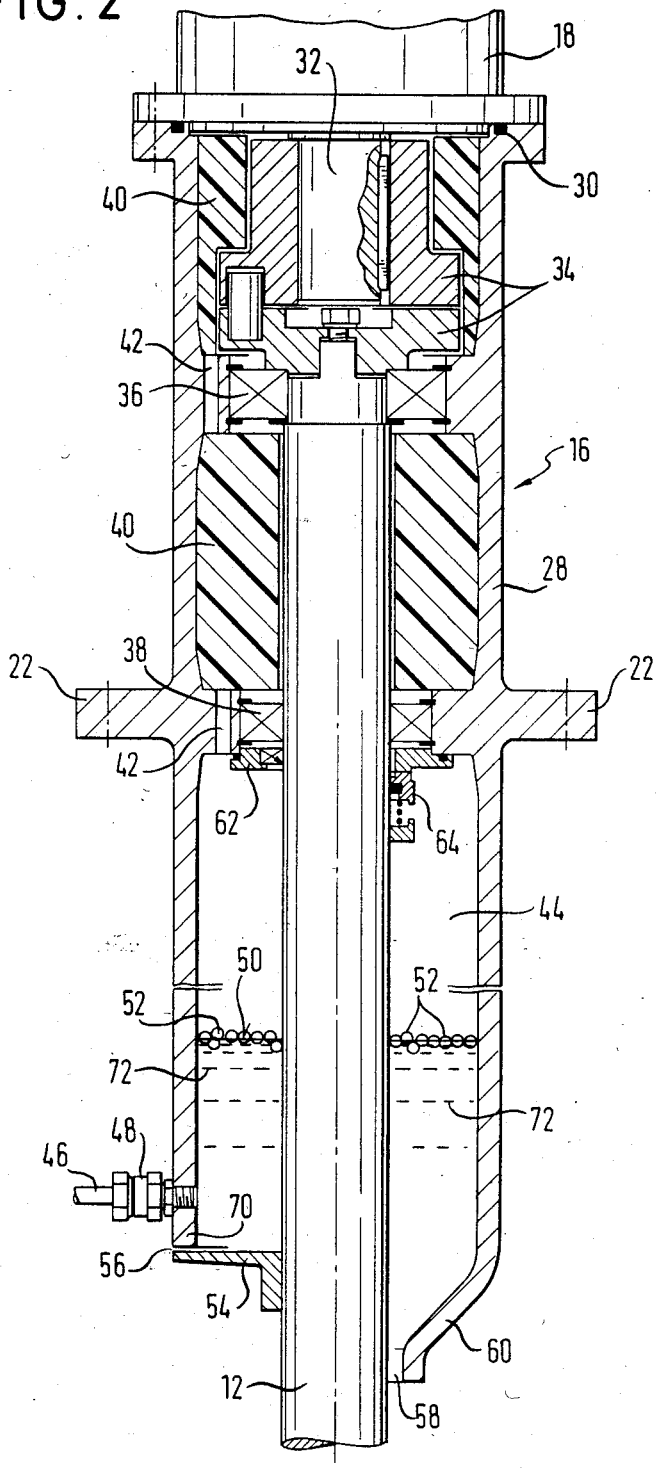
FIG. 2 is a section of a gastrap, in which the bearings and the coupling of the agitator are accommodated so as to be protected against the medium.

FIG. 2 is a view on a larger scale of the gastrap 16. The gastrap 16 is made up of a generally elongated cylindrical housing 28 manufactured of a suitably strong material as for example steel or possibly stainless steel, the flange 22 being formed integrally on the housing 28 or, as shown, joined firmly to it. The motor 18 is flange-fitted to the top end of the housing 28 with a gasket 30 therebetween, for example in the form of an o-ring. A stub shaft 32 of the motor 18 projects into the housing 28.

The end of the shaft 12 that is to the top in FIG. 2 is torque-transmittingly joined to the stub shaft 32 by way of a coupling 34, such coupling being of any suitable construction.

The shaft 12 is turningly supported on two axially spaced bearings 36 and 38 mounted in the housing 28, the bearing 38 to be seen in the present working example being a radial bearing, whereas the bearing 36 is a combined radial and axial bearing. Both of the bearings are preferably anti-friction bearings.

The compartment housing the bearings and the coupling, that is to say the space inside the housing 28 between the motor 18 and the lower bearing 38 is, to the extent it is not taken up by the bearings of the coupling, the shaft 12 and the stub shaft 32, packed with a synthetic resin 40 in order, as will be explained later, to keep the air volume of the compartment as small as possible. The synthetic resin packing 40 is kept sufficiently clear of the rotating parts, as for example the shaft 12 and the coupling 34 to make sure that it does not act as a brake on these parts.

The lower part of the housing 28 at a lower level than the bearing 38 forms a gas space 44, which is fitted with a check valve 48 by way of a tube 46 so that a gas, and more specially air, may be introduced into the compartment periodically or continuously.

The housing 28 is, as may be seen from FIG. 2, not completely shut off from the medium to be agitated and in fact there is an opening in the form of a gap 56 and 58 of a given size respectively. It is through this gap 56 or 58 that the medium may make its way into the gas space 44 of the housing 28 up to a certain permitted level, the surface of the liquid level of this medium having risen as far as this in the gas space 44 of the housing 28 being referenced 50. Floats 52 are placed in the gas space 44, that may for example be in the form of spherical pieces of bouyant synthetic resin, that float and move upwards with the medium entering the housing 28 and at least cover its surface.

An impeller 54 is keyed to the agitator shaft 12 outside the housing 28, such impeller forming a given gap 56 at the lower end 70 of the housing 28. In lieu of having such an impeller 54 it would be possible for the lower end of the housing 28 to be furnished with a conical structure 60 pointing towards the shaft 12 so that between the end of the conical structure and the shaft 12 there would be a gap 58 of a given size.

In addition to the gas cushion sealing effect for the bearings and the coupling to keep out the medium 72 therefrom produced by the gas in the gas space 44, it is possible to have a seal between the housing 28 and the shaft 12 at a lower level than the lower bearing 38, such seal being for example in the form of a lip seal 6 or in the form of sealing bushing 64. In this case the compartment, that is to say the space between the motor 18 and the lower bearing 38 may be filled with oil in order to lubricate the sealing bushing 64, whereas the filling 40 of synthetic resin would not be used.

If in this case the medium to be agitated is an oil, it is possible to have a linking opening between the compartment and the outer side of the housing 28 (although this is not shown in the figure), such opening producing a connection with the surrounding medium, that in this case may be used as a lubricant. However in order to keep out solid particles and more specially particles of dirt, this connection duct will have a suitable strainer or frit filter within it.

As will be seen from FIG. 1 the entire agitator is placed under the level 26 of the medium to be agitated with its axis upright. It is however not necessary for the agitator always to be upright and it may be on a slant with an angle of about 80° to the vertical and be operated at such an angle.

When the agitator is running while plunged into the medium to be agitated, the gastrap 16, that is to say the space inside its housing 28, is filled with a gas and more specially with air. The medium penetrates into the gas space 44 of the downwardly opening gastrap 16 through the gap 56 or 58 and rises in the gas space 44. It is possible for gas to be periodically or continuously introduced into the gas space through the tube 46 so that the level 50 of the medium 72 contained in the gas space 44 may be kept at a desired height while keeping the liquid level 50 at a sufficient distance from the lower bearing 38. The check valve 48 is used in this respect to keep the medium from flowing back into the tube 46, in the event of the gas supply failing.

The floats 52 packed in the gas space 44 rise and float with the medium moving into the gas space 44. They are present in such a quantity that at least the liquid surface 50 of the medium that has entered the apparatus is completely covered over. The agitation and the rotating shaft 12 keep the medium on the move. The floats 52 floating on the surface of the medium 72 having passed into the gas space 44 cause the liquid surface to be shut off from the gas space 44 and mean that it is hardly possible for gas in the gas space 44 to be absorbed in the medium 72.

However any gas that has been swept up by medium 72 and been lost to the outside is made good through the connection tube 46. The gas cushion formed in the gas space 44 is therefore continuously replenished via the tube 46 taking into account or matching the pressure of the surrounding medium. Solid particles that have penetrated into the gastrap with the medium and which have come down in it as a sediment are expelled to the outside by way of the impeller 54, that turns with the shaft 12, through the gap 56 so that they will not foul the lower part of the gastrap. This same effect may be produced by the conical design of the housing, the function of the impeller in this case being assumed by the shaft 12 itself, that expels any sediment of solid particles that come in by way of the gap 58.

The synthetic resin packing 40 decreases the volume of air in the housing 28 and therefore the air or gas cushion to be maintained as well.

In keeping with a modified form of the invention, the motor 18 is also accommodated in the housing 28, that is to say, placed in the gastrap 16. When the agitator is running in water it is also possible for the sealing bushings 62 and 64 respectively to be used, in which case the compartment for the bearings and the coupling is filled with water and the bearings are best in the form of water lubricated plain bearings. If sealing rings are employed, the lower communicating hole 42 is shut off.

The connecting hole, not shown, between the compartment and the outside of the gastrap 16 is best formed in the vicinity of the upper end of the housing 28 and this hole is furthermore move specifically used to make the pressure in the compartment equal to that of the surrounding medium.

The gas used for forming and maintaining the gas cushion is more specially an inert gas, for example when the motor as well is accommodated in the housing 28.

We claim:

1. An agitator for the agitation of liquid media, specifically for use in a completely submerged condition, comprising a motor; a shaft driven by said motor; agitating vanes mounted on the shaft; a submersible housing accommodating a portion of said shaft extending downwardly from said motor and being open in a downward direction; bearings mounted in said housing to support said shaft in said housing; and a coupling mounted between the motor and the shaft the bearings and the coupling being placed in said housing, said housing being filled with a gas with the formation of a gas cushion to prevent a medium from entering the bearings and the coupling, said housing having floats positioned at a lower part of the housing, the floats floating on a surface of the medium entering the housing and at least covering said surface.

2. The agitator as claimed in claim 1, wherein the housing is supplied with gas by way of a duct joined thereto for maintaining the gas cushion.

3. The agitator as claimed in claim 1, wherein the housing has a compartment accommodating the coupling and the bearings, the compartment being essentially filled with synthetic resin in order to reduce a gas volume in the housing.

4. The agitator as claimed in claim 3, wherein the lower end of the housing is of a conical structure pointing towards the shaft.

5. The agitator as claimed in claim 1; further including an impeller which is keyed on the shaft at a given distance from a lower end of the housing.

6. The agitator as claimed in claim 1, wherein the housing has a compartment accommodating the bearings and the coupling, the compartment being filled with oil.

7. The agitator as claimed in claim 6, wherein in the housing of the downwardly opening gastrap a connection hole is formed between the compartment and the outside of the housing.

8. The agitator as claimed in claim 1, wherein said gas is air.

9. The agitator as claimed in claim 1, wherein at least one sealing ring is provided between one of the bearings and the medium.

* * * * *